US009345984B2

(12) United States Patent
White

(10) Patent No.: US 9,345,984 B2
(45) Date of Patent: May 24, 2016

(54) TETHERED FLYING DISKS

(76) Inventor: Kevin White, Prairie Village, KS (US)

( * ) Notice: Subject to any disclaimer, the term of this patent is extended or adjusted under 35 U.S.C. 154(b) by 439 days.

(21) Appl. No.: 13/544,088

(22) Filed: Jul. 9, 2012

(65) Prior Publication Data

US 2014/0011419 A1 Jan. 9, 2014

(51) Int. Cl.
*A63H 33/18* (2006.01)

(52) U.S. Cl.
CPC ..... *A63H 33/18* (2013.01)

(58) Field of Classification Search
CPC ... A63H 33/18; A63F 9/02; A63F 2007/4087; A63B 67/10; A63B 69/0079; A63B 43/007
USPC ..... 446/46–48; 273/331, 335, 332; 473/506, 569, 588, 589; 119/702, 707
See application file for complete search history.

(56) References Cited

U.S. PATENT DOCUMENTS 3,855,728 A * 12/1974 Hynds ..... A63H 33/18 446/46
3,976,297 A * 8/1976 Seymour ..... A63F 9/02 273/335
4,039,189 A 8/1977 Headrick et al.
4,182,073 A 1/1980 Tabet
4,346,902 A * 8/1982 Warehime ..... A63B 67/002 473/465
4,568,297 A 2/1986 Dunipace
4,752,267 A 6/1988 Layman
4,813,685 A * 3/1989 Gaston ..... A63F 7/382 473/576
RE34,208 E * 3/1993 Shaw ..... A63B 67/10 426/104
5,254,077 A 10/1993 Nottingham
5,263,819 A * 11/1993 O'Leary ..... A63H 33/18 446/46
5,275,417 A * 1/1994 Seymour ..... A63H 33/18 273/330
5,358,440 A 10/1994 Zheng
5,480,334 A * 1/1996 Wilson ..... A63H 33/18 446/46
5,531,624 A 7/1996 Dunipace
5,536,195 A 7/1996 Stamos
5,611,720 A 3/1997 Vandermaas
6,179,737 B1 1/2001 Adler
6,422,959 B1 7/2002 Hsu
6,443,793 B1 * 9/2002 Huebl ..... A63H 27/02 242/371
7,294,036 B2 11/2007 Potts
2004/0116040 A1 * 6/2004 Mulvihill ..... A63H 33/00 446/247
2004/0198137 A1 * 10/2004 Ruiz ..... A63H 33/18 446/46
2005/0085156 A1 * 4/2005 Ng ..... A63H 1/30 446/247
2009/0253541 A1 * 10/2009 Darville ..... A63B 65/00 473/572

* cited by examiner

*Primary Examiner* — Gene Kim
*Assistant Examiner* — Alyssa Hylinski
(74) *Attorney, Agent, or Firm* — David E Herron, II

(57) ABSTRACT

The invention is an apparatus comprising all apparatus, as well as a method that incorporates the apparatus. The apparatus includes an upper flying disk and a lower flying disk having an upper surface, and a cord connecting the two flying disks.

9 Claims, 7 Drawing Sheets

Fig. 3
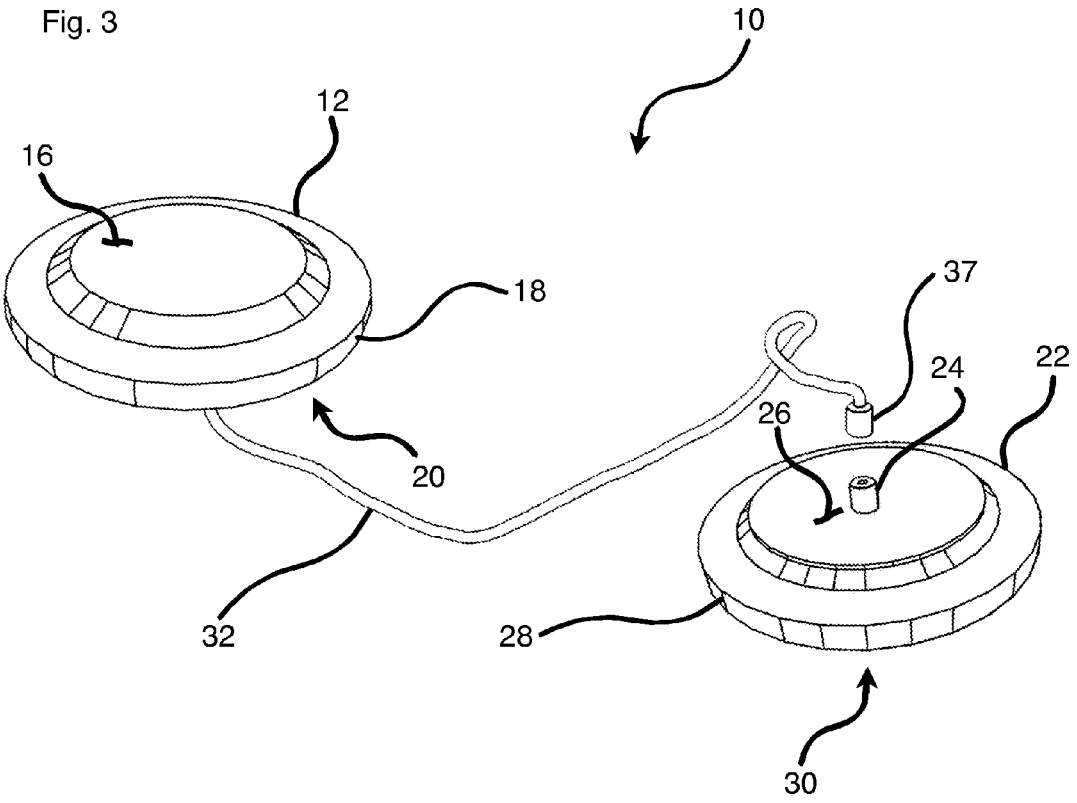
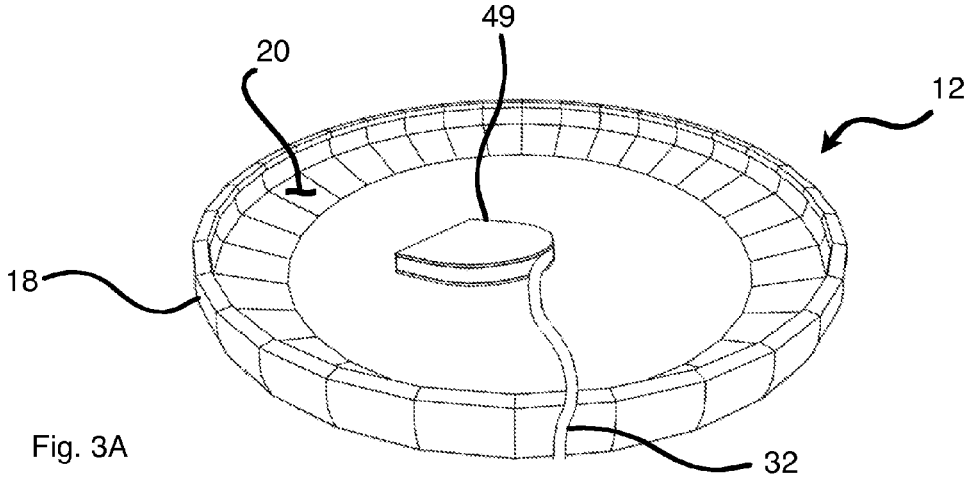
Fig. 3A

TETHERED FLYING DISKS

SUMMARY OF THE INVENTION

The invention is an apparatus comprising an apparatus with tethered flying disks, as well as a method that incorporates the same.

The Inventive Apparatus

The inventive apparatus is an apparatus that includes an upper flying disk having an upper surface, a perimeter, a centerpoint, and a lower surface. The apparatus further includes a lower flying disk that has an upper surface, a perimeter, a centerpoint, and a lower surface. A cord connects the upper flying disk to the lower flying disk. The first end of the cord attaches adjacent the centerpoint of the lower flying disk, and the cord passes through an aperture positioned near the centerpoint of the upper flying disk. In a preferred embodiment, the second end of the cord engages the upper flying disk adjacent its centerpoint.

Optionally, the apparatus may have an aperture positioned at the centerpoint of the upper flying disk, with the cord passing through the aperture. In like manner, the apparatus may also have a hole positioned adjacent the centerpoint of the lower flying disk, with the cord passing through the hole. In a preferred embodiment, the cord is a static cord that does not stretch. In a second preferred embodiment, the cord comprises elastic that does allow stretch.

Optionally, the cord may have an adjustable length. In a preferred embodiment, the cord is made adjustable threading a loop of the cord through the aperture on the upper flying disk so that the loop extends above the upper surface of the upper flying disk. A bead is mounted on the loop of the cord, the bead having diameter larger than the aperture.

Preferably, the upper flying disk is slightly larger than the lower flying disk. The size disparity enables the lower flying disk to engage within the upper flying disk in a nested position.

The Inventive Method

The inventive method includes the steps of providing an upper flying disk having an upper surface, a perimeter having a downwardly depending edge, a centerpoint, and a lower surface. The method also includes the step of providing a lower flying disk having an upper surface, a perimeter, a centerpoint, and a lower surface. Moreover, the method requires one to provide a cord and connecting it adjacent its first end of the cord to the lower surface of the upper flying disk. It also requires one to connect the cord adjacent its second end to the centerpoint of the upper disk.

The method also requires one to engage the upper flying disk and the lower flying disk together into an engaged position, then throw the upper flying disk and lower flying disk In a preferred embodiment of the inventive method, one may make an aperture at the centerpoint of the upper flying disk and pass the cord through the aperture. In like manner, one may also make a hole adjacent the centerpoint of the lower flying disk and pass the cord through the hole.

Alternatively, the cord may comprise elastic. Moreover, one may also select a cord to have an adjustable length.

In a preferred embodiment, the flying disks nest. In order to accomplish this nesting aspect, the engaging step includes the steps of selecting the upper flying disk to have a circumference slightly larger than a circumference of the lower flying disk so that the lower flying disk engages within the upper flying disk in a nested position.

Finally, the inventive method may involve two players—a thrower and a receiver, wherein, the throwing player performs the throwing step while the disks are in the engaged position; and, the receiving player catches the upper flying disk and the lower flying disk. Of course, the disks usually disengage while airborne, so that the method presents the challenge of catching both disks when in a disengaged position.

Other objects, advantages and novel features of the present invention will become apparent from the following detailed description of the invention when considered in conjunction with the accompanying drawings.

BRIEF DESCRIPTION OF THE DRAWINGS

FIG. 3 is a perspective view detailing another embodiment of the inventive apparatus, according to the principles of the invention.

FIG. 3A is a perspective view detailing underneath the upper disk that is shown in FIG. 3.

DETAILED DESCRIPTION OF THE PREFERRED EMBODIMENTS

Figure 1:
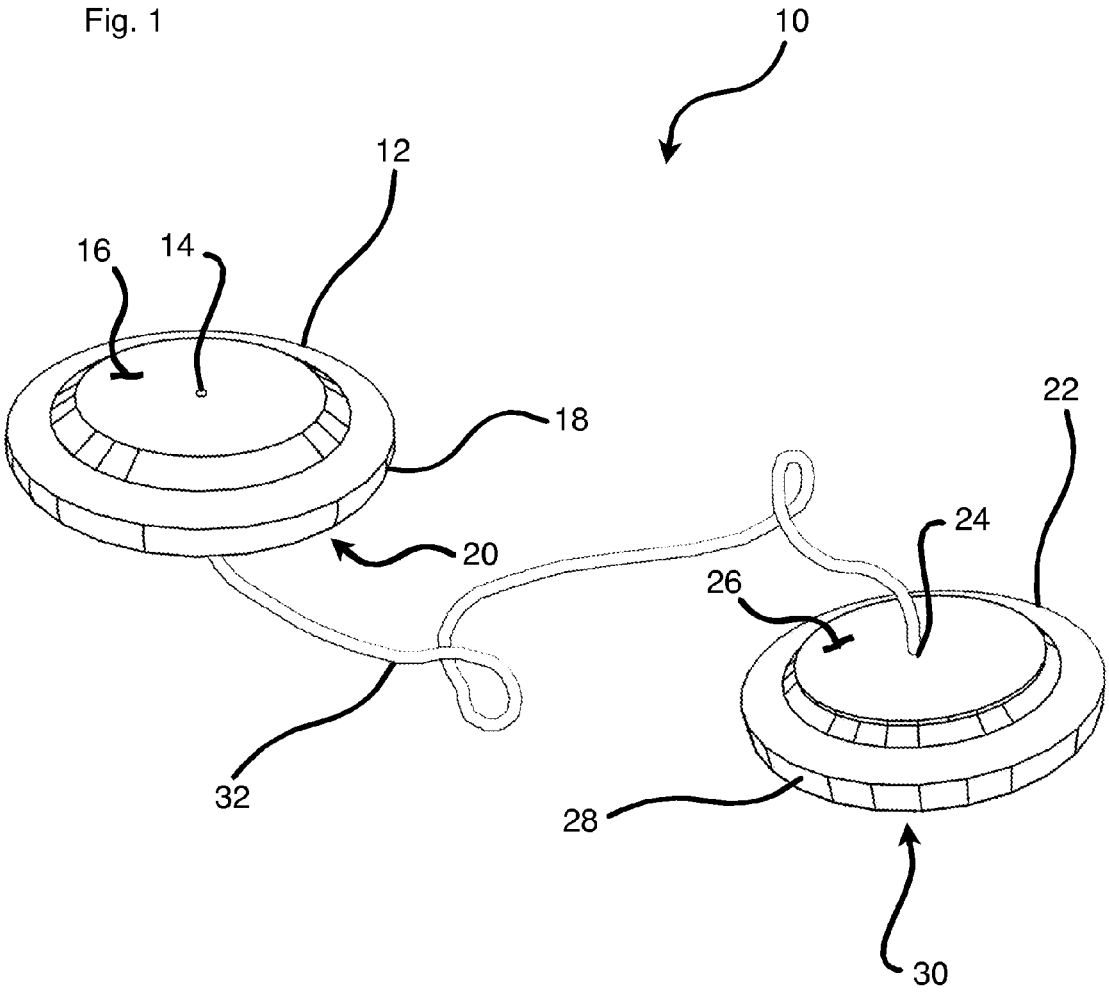
FIG. 1 is a perspective view detailing the inventive apparatus, according to the principles of the invention.

FIG. 1 shows a perspective view that details the inventive apparatus 10 and its component parts. Specifically, the apparatus 10 includes an upper disk 12 having an upper surface 16, a lower surface 20, and bound by a perimeter edge 18. Of course, the upper disk 12 also has a center point 14 about which the disk rotates as the disk is thrown airborne.

As shown in FIG. 1, the apparatus 10 also includes a lower disk 22 having an upper surface 26, a lower surface 30, and a perimeter edge 28. When the lower flying disk 22 is thrown, it rotates about an axis through its centerpoint 24.

Still referring to FIG. 1, a cord 32 connects the upper flying disk 12 to the lower flying disk 22. Specifically, the cord 32 attaches at a first end to the lower surface 20 of the upper flying disk 12 by engaging adjacent the center point 14 of the upper flying disk 12. In like manner, the cord 32 attaches at its second end to the upper surface 26 of the lower flying disk 22, preferably at the center point 24 of the lower flying disk.

Figure 2:
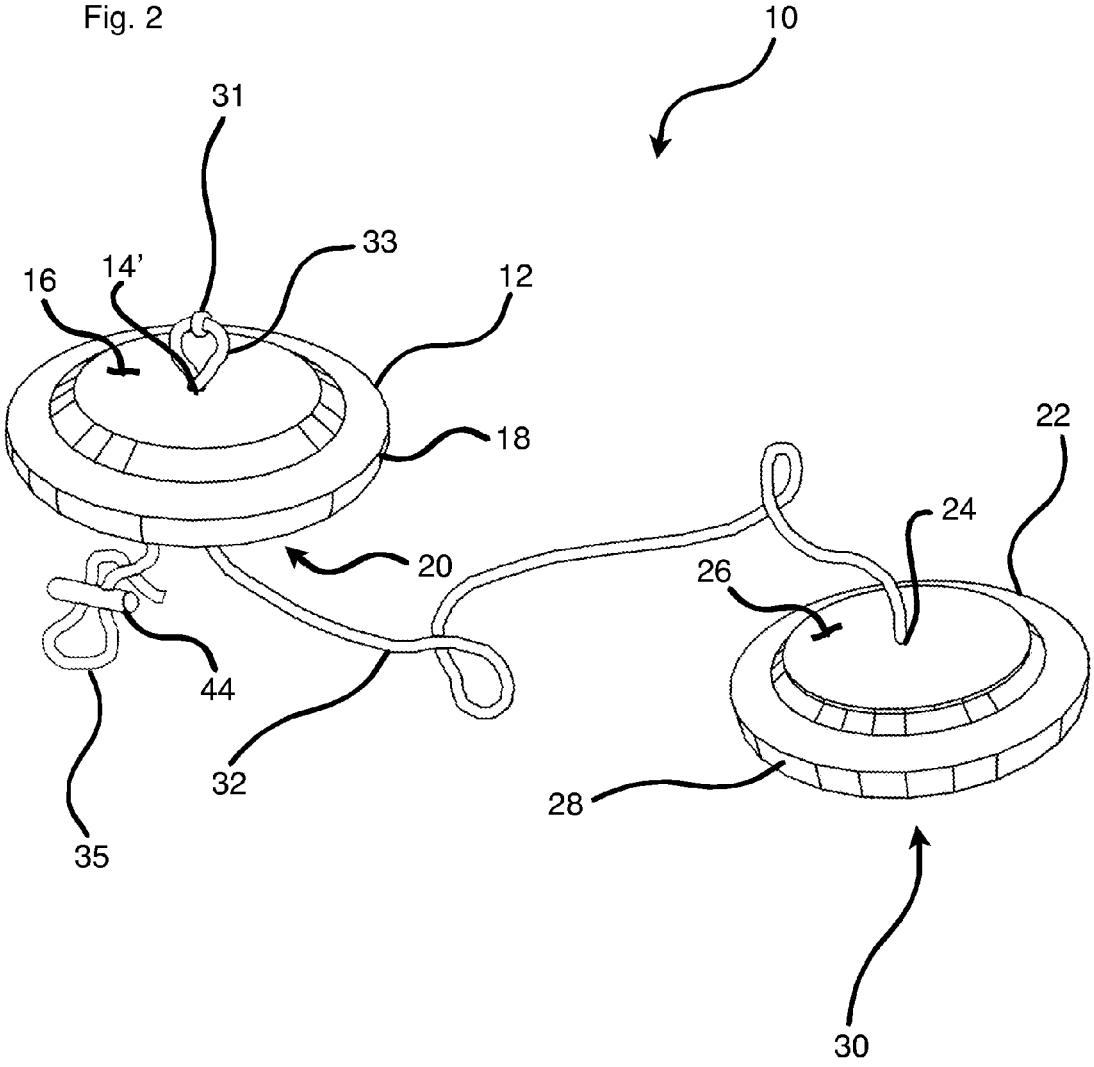
FIG. 2 is a perspective view detailing a second embodiment of the inventive apparatus, according to the principles of the invention.

FIG. 2 shows a perspective view that details a second embodiment of the inventive apparatus 10 and its component parts. Specifically, the apparatus 10 includes an upper disk 12 having an upper surface 16, a lower surface 20, and bound by a perimeter edge 18. Of course, the upper disk 12 also has a center point 14' about which the disk rotates as the disk is thrown airborne, the centerpoint 14' also having an aperture allowing the cord 32 to pass through.

As shown in FIG. 2, the apparatus 10 also includes a lower disk 22 having an upper surface 26, a lower surface 30, and a perimeter edge 28. When the lower flying disk 22 is thrown, it rotates about an axis through its centerpoint 24.

Still referring to FIG. 2, a cord 32 connects the upper flying disk 12 to the lower flying disk 22. Specifically, the cord 32 attaches at a first end to the lower flying disk 22 by engaging adjacent the centerpoint 24 of the lower flying disk 22. In this embodiment, the cord 32 passes from the lower flying disk 22 and connects to the upper flying disk 12 by passing a loop 33 of the cord 32 through the center point 14' in the upper flying disk 12. The loop 33 bears a bead 31 that has a diameter larger than the aperture at the center point 14', which prevents the cord 32 from becoming disengaged from the upper flying disk 12.

As shown in FIG. 2, the cord 32 passes downwardly through the aperture 14' toward its terminus. A cord lock 44 is mounted the cord 32 adjacent its second end. The cord lock 44 may comprise any known spring-loaded biasing cord lock, such as a spring loaded biasing lock.

As shown in FIG. 2, one may form a loop 35 of the cord 32 that passes through the cord lock 44. In order to adjust the free length of the cord 32, one may make the loop 35 larger by pulling a greater length through the cord lock 44.

FIG. 3 shows a perspective view that details another preferred embodiment of the inventive apparatus 10 and its component parts. As with the previously-discussed embodiments, this embodiment of the apparatus 10 includes an upper disk 12 having an upper surface 16, a lower surface 20, and bound by a perimeter edge 18.

The embodiment of the apparatus 10 shown in FIG. 3 also includes a lower disk 22 having an upper surface 26, a lower surface 30, and a perimeter edge 28. A cord 32 attaches adjacent its to the lower flying disk 22 by engaging adjacent the centerpoint 24 of the lower flying disk 22. The cord 32 may comprise a snap connector 37 that enables the cord 32 to disconnect, which may prevent unwanted tangles or the danger of choking.

The embodiment shown in FIG. 3 shows the snap connector having two parts, one of which is anchored to the upper surface 26 of the lower disk 22. Of course, the connector 37 may be positioned at any suitable location, including at an intermediate portion of the cord 32.

FIG. 3A is an isolated perspective view from the underside of the upper flying disk 12. In this embodiment, the cord 32 winds into a biasing coil 49 attached to the lower surface 20 of the upper disk 12. When the disks 12,22 (See FIG. 3) are in a nested position (FIG. 5, supra), the cord 32 will be completely retained within the coil 49. As the disks are airborne and begin to separate, the cord 32 is let out of the coil 49. In a preferred embodiment of the apparatus shown in FIG. 3 and FIG. 3A, the coil 49 is biased in a manner that will retract the cord 32 back into the coil 49 when a preselected length of cord 32 exits the coil.

Figure 4:
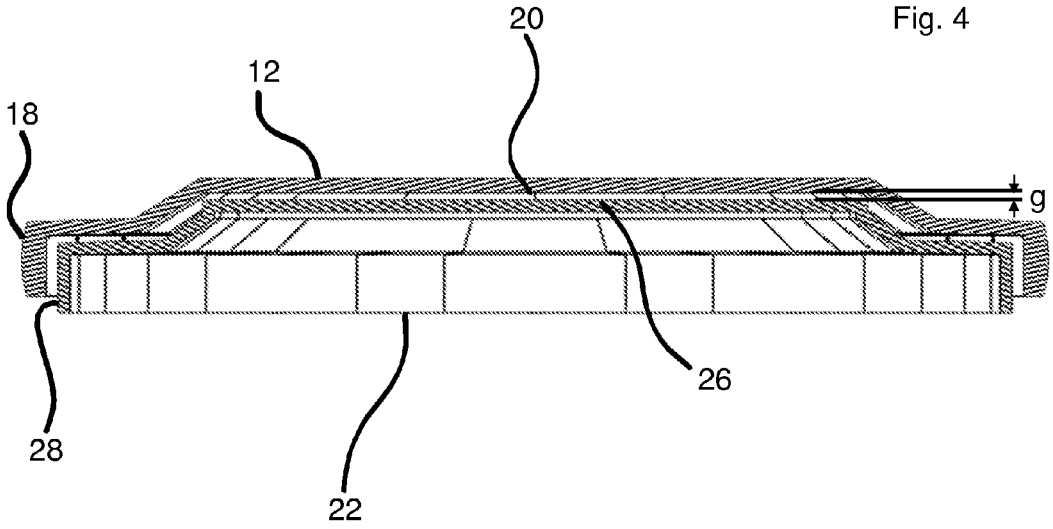
FIG. 4 is a cross-sectional view of the inventive apparatus, shown with the flying disks in a nested position.

FIG. 4 is a cross-sectional view of the apparatus, shown with the lower flying disk 22 nested within the upper flying disk 12. As shown, the upper flying disk 12 has a perimeter edge 18 that defines a circumference that is slightly larger than the circumference of the lower flying disk 22. Thus, the perimeter edge 18 of the upper flying disk 12 fits over and around the perimeter edge 28 of the lower flying disk, enabling the two flying disks 12, 22, to nest as shown.

As shown in FIG. 4, the upper surface 26 (see FIG. 1) of the lower flying disk. 22 is adjacent the lower surface 20 (see FIG. 1) of the upper flying disk 12 when in a nested position. Preferably, a small gap g separates the upper surface 26 of the lower flying disk 22 from the lower surface 20 (sec FIG. 1) of the upper flying disk 12. This gap g not only facilitates the disengagement that will occur when airborne, the gap g will also allow for stowage of the cord 32.

Figure 5:
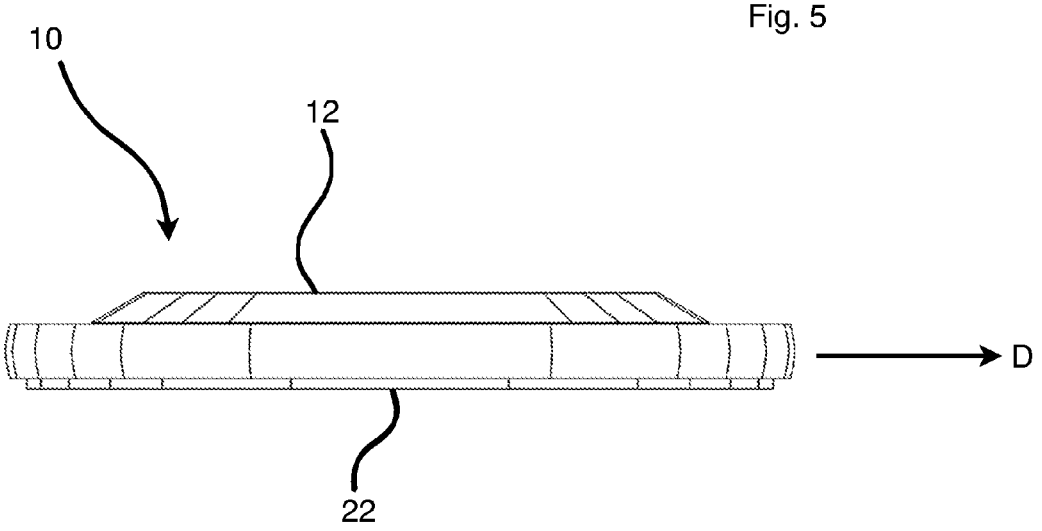
FIGS. 5-7 are comparative and progressive perspective views that detail the relative position of the disks when they separate from one another as they are airborne.

FIG. 5 shows a perspective view of the apparatus 10, shown with the lower flying disk 22 nested into the upper flying disk 12 as the flying disks are thrown in direction 13. This FIG. 5 intends to show the relative positions of the flying disks immediately after being thrown in direction D.

Figure 6:
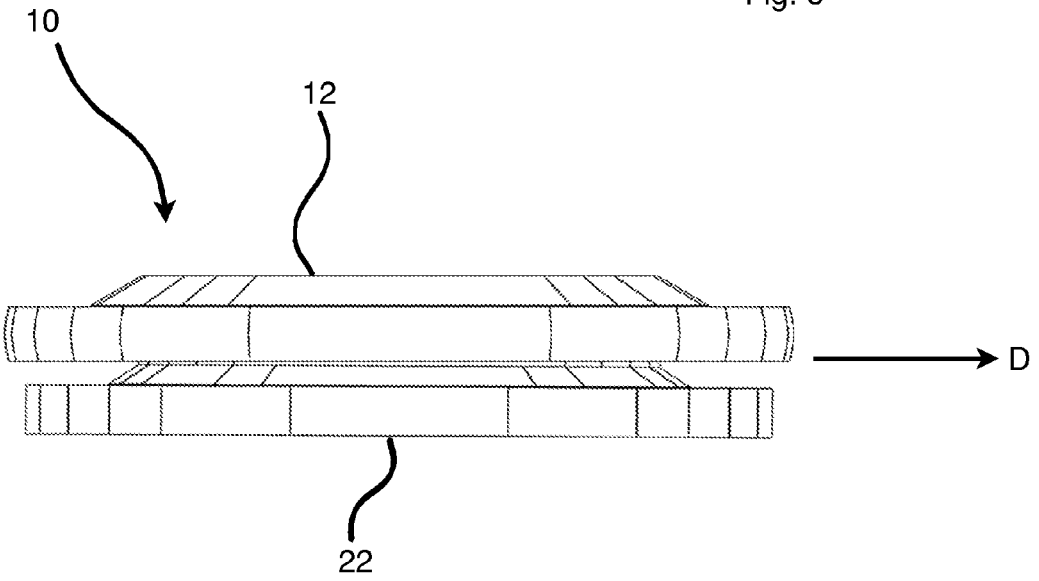

FIG. 6 shows a perspective view of the apparatus 10. By way of comparison, FIG. 6 shows the configuration of the apparatus 10 shortly after it has traveled a short distance in Direction D. As shown in FIG. 6, the upper flying disk 12 begins to separate from the lower flying disk 22 as the apparatus 10 travels in Direction D. As they two disks 12, 22 separate from one another, air currents pass between the upper flying disk 12 and the lower flying disk 22 to create even further separation.

Figure 7:
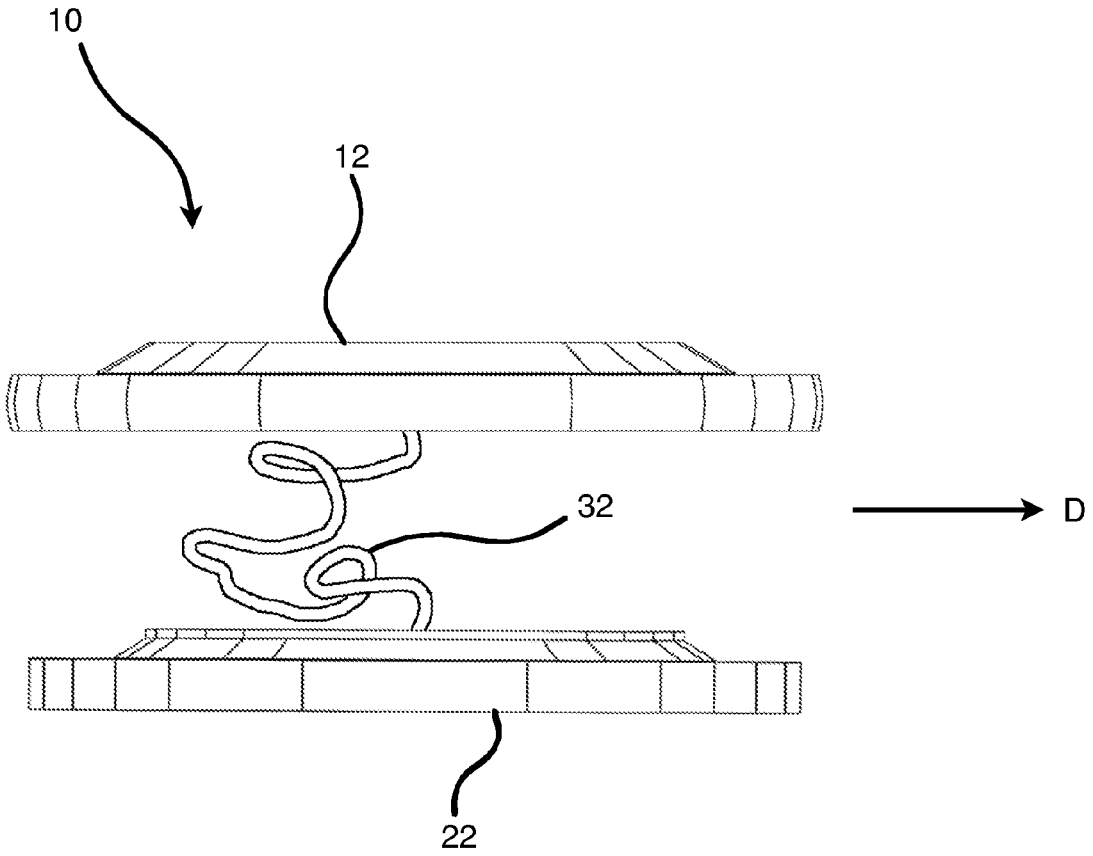

FIG. 7 shows another comparative perspective view of the apparatus 10. By way of comparison, FIG. 7 shows the configuration of the apparatus 10 after it has traveled a greater distance than the apparatus had traveled in FIG. 6. As the apparatus travels in direction D the upper flying disk 12 continues to separate itself from the lower flying disk 22, and the cord 32 connecting the flying disks 12, 22 begins to unravel between them. Of course, the cord 32 will limit the separation distance that sets the two disks apart 12, 22 while airborne.

Figure 8:
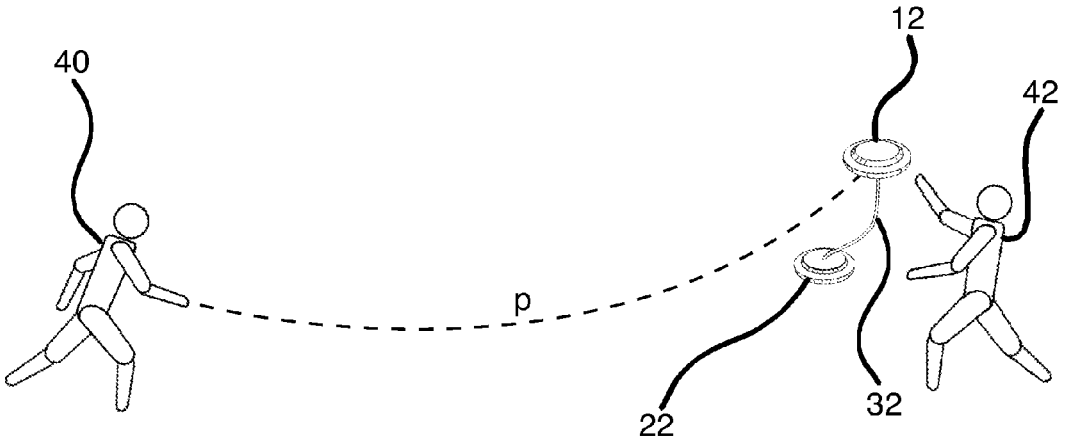
FIG. 8 shows the inventive apparatus in use by a throwing player and a receiving player.

FIG. 8 shows the apparatus 10 (see FIG. 1) in use by a throwing player 40 and a receiving player 42. As the apparatus 10 (See FIG. 1) travels from the throwing player 40 toward the receiving player 42 along the flight path p, the upper disk 12 and lower flying disk 22 separate from one another, but remain tethered to one another by means of the cord 32. The separation of the disks 12, 22 presents a challenge to the receiving player 42 in that the receiving player 42 may attempt to catch both disks 12, 22, usually one disk in each hand. Alternatively, additional receiving players (not shown) may be added. Of course, other means and methods of playing with the apparatus are certainly within the scope of the invention.

Although the present invention has been described and illustrated in detail, it is to be clearly understood that the same is by way of illustration and example only, and is not to be taken by way of limitation. The spirit and scope of the present invention are to be limited only by the appended claims that precisely define the metes and bounds of the invention.

I claim:

1. An apparatus comprising:

an upper flying disk having an upper surface, a perimeter, a centerpoint, and a lower surface;

a lower flying disk having an upper surface, a perimeter, a centerpoint, and a lower surface, wherein the upper flying disk has a circumference slightly larger than the lower flying disk, thereby enabling the lower flying disk to engage within the upper flying disk in a nested position;

a cord having a first end and a second end, the cord connecting the lower flying disk to the upper flying disk;

an aperture positioned at the centerpoint of the upper flying disk;

a first loop of cord passing through the aperture in the upper flying disk;

a bead mounted on the first loop of cord, the bead having a diameter larger than a diameter of the aperture;

a cord lock positioned on the cord so as to form a second loop of cord positioned proximate the second end of the cord; wherein, a length of cord separating the upper flying disk from the lower flying disk may be adjusted by selectively adjusting the second loop.

2. The apparatus as in claim 1, further comprising a hole positioned adjacent the centerpoint of the lower flying disk; wherein the cord passes through the hole.

3. The apparatus as in claim 1, the cord further comprising a snap device enabling the cord to separate into distinct portions of cord.

4. The apparatus as in claim 1, wherein the cord is elastic.

5. The apparatus as in claim 1, further comprising a third flying disk attached to the cord.

6. A method comprising the steps of:

providing an upper flying disk having an upper surface, a perimeter having a downwardly depending edge, a centerpoint, and a lower surface;

providing a lower flying disk having an upper surface, a perimeter, a centerpoint, and a lower surface;

providing a cord having a first end and a second end;

positioning a cord lock on the cord by passing the cord through the cord lock;

connecting the cord adjacent the first end of the cord to the lower surface of the upper flying disk adjacent the centerpoint of the upper disk;

connecting the cord adjacent the second end of the cord to the upper surface of the lower flying disk adjacent the centerpoint of the lower flying disk;

providing an adjustment mechanism including a first loop of cord passing through an aperture in the upper flying disk, a bead mounted on the loop of cord, the bead bearing a circumference greater than a diameter of the aperture, and forming a second loop of cord that passes through the cord lock;

selectively adjusting a length of cord in the second loop;

engaging the upper flying disk and the lower flying disk together into an engaged position; and, throwing the upper flying disk and lower flying disk while in the engaged position such that the disks disengage while airborne.

7. The method as in claim 6, further comprising the steps of:

making a hole adjacent the centerpoint of the lower flying disk; and, passing the cord through the aperture and the hole.

8. The method as in claim 6, the engaging step further including the steps of:

selecting the upper flying disk to have a circumference slightly larger than a circumference of the lower flying disk; wherein, the lower flying disk engages within the upper flying disk in a nested position.

9. The method as in claim 6, further comprising the steps of:

performing the throwing step while the disks are in the engaged position; and, catching the upper flying disk and the lower flying disk.

* * * * *